US009833825B2

(12) United States Patent
Nakaura et al.

(10) Patent No.: US 9,833,825 B2
(45) Date of Patent: Dec. 5, 2017

(54) PRODUCTION METHOD AND PRODUCTION DEVICE FOR TUBE WITH SPIRALLY GROOVED INNER SURFACE

(71) Applicant: Mitsubishi Aluminum Co., Ltd., Minato-ku (JP)

(72) Inventors: Yusuke Nakaura, Mishima (JP); Takeshi Sakagami, Sunto-gun (JP); Yuki Hateruma, Numazu (JP)

(73) Assignee: Mitsubishi Aluminum Co., Ltd., Minato-ku (JP)

( * ) Notice: Subject to any disclaimer, the term of this patent is extended or adjusted under 35 U.S.C. 154(b) by 0 days.

(21) Appl. No.: 15/326,286

(22) PCT Filed: Jul. 16, 2015

(86) PCT No.: PCT/JP2015/070412

§ 371 (c)(1),
(2) Date: Jan. 13, 2017

(87) PCT Pub. No.: WO2016/010113

PCT Pub. Date: Jan. 21, 2016

(65) Prior Publication Data

US 2017/0203348 A1 Jul. 20, 2017

(30) Foreign Application Priority Data

Jul. 18, 2014 (JP) ..... 2014-148340

(51) Int. Cl.
*B21C 37/20* (2006.01)
*B21C 47/26* (2006.01)
(Continued)

(52) U.S. Cl.
CPC ..... *B21C 37/20* (2013.01); *B21C 1/22* (2013.01); *B21C 47/26* (2013.01); *B21D 53/06* (2013.01); *F28F 1/025* (2013.01)

(58) Field of Classification Search
CPC .. B21C 1/22; B21C 1/24; B21C 37/20; B21C 37/202; B21D 11/14; D07B 3/02; D07B 7/14; D01H 1/003; B65H 81/06
(Continued)

(56) References Cited

U.S. PATENT DOCUMENTS 705,331 A * 7/1902 Emery ..... D01H 1/04 140/60
1,973,031 A * 9/1934 Wrage ..... B21C 1/30 72/278

(Continued)

FOREIGN PATENT DOCUMENTS

CN 1100348 A 3/1995
CN 1165287 A 11/1997

(Continued)

OTHER PUBLICATIONS

International Search Report dated Oct. 20, 2015 in PCT/JP2015/070412 filed Jul. 16, 2015.

(Continued)

*Primary Examiner* — Jason L Vaughan
(74) *Attorney, Agent, or Firm* — Oblon, McClelland, Maier & Neustadt, L.L.P.

(57) ABSTRACT

A method in accordance with the present application includes sending a raw tube from a drum to an unwinding side capstan while the raw tube is rotated around a central axis perpendicular to a winding shaft of the drum by rotating the drum and the unwinding side capstan about the central axis concurrently with unwinding of the raw tube from the drum holding the raw tube, on an inner surface of which multiple straight grooves along a longitudinal direction of the raw tube are formed with an interval in a circumferential direction, in a coil shape, to wind the raw tube around the unwinding side capstan, and drawing in which the unwound raw tube is drawn while the diameter of the raw tube is (Continued)

reduced, and then the raw tube is wound around the drawing side capstan to twist the raw tube and obtain an inner spiral grooved tube.

8 Claims, 12 Drawing Sheets

(51) Int. Cl.
*B21C 1/22* (2006.01)
*B21D 53/06* (2006.01)
*F28F 1/02* (2006.01)

(58) Field of Classification Search
USPC ..... 72/64, 65, 371, 37; 57/11, 12, 59
See application file for complete search history.

(56) References Cited

U.S. PATENT DOCUMENTS 2,250,610 A * 7/1941 Simons ..... B21C 1/04 29/33 F
3,866,403 A * 2/1975 Zimmermann, Jr. .. B65H 49/28 57/1 UN
3,955,390 A * 5/1976 Geary ..... B21F 7/00 72/278
3,961,514 A * 6/1976 Geary ..... B21F 7/00 72/274
4,735,071 A * 4/1988 Ueda ..... B21C 37/207 29/890.48
4,757,700 A * 7/1988 Dotti ..... B21C 37/12 72/371
4,766,751 A * 8/1988 Ueda ..... B21D 11/14 72/181

FOREIGN PATENT DOCUMENTS

| | | | |
|---|---|---|---|
| CN | 101416016 | A | 4/2009 |
| JP | 58-167030 | A | 10/1983 |
| JP | 59-209430 | A | 11/1984 |
| JP | 61-088918 | A | 5/1986 |
| JP | 6-190476 | A | 7/1994 |
| JP | 10-071419 | A | 3/1998 |
| JP | 10-166086 | A | 6/1998 |
| JP | 2012-236225 | A | 12/2012 |

OTHER PUBLICATIONS

Chinese Office Action issued in Application No. CN 201580046588.7 dated Jul. 7, 2017 (w/ partial English translation).

* cited by examiner

PRODUCTION METHOD AND PRODUCTION DEVICE FOR TUBE WITH SPIRALLY GROOVED INNER SURFACE

TECHNICAL FIELD

The present invention relates to a method of producing an inner spiral grooved tube used for a heat transfer tube of a heat exchanger and an apparatus for producing the inner spiral grooved tube.

Priority is claimed on Japanese Patent Application No. 2014-148340, filed Jul. 18, 2014, the content of which is incorporated herein by reference.

BACKGROUND ART

In the fin tube type heat exchangers such as air conditioners and water heaters, heat exchange is performed by inserting the heat transfer tube, which is for passing refrigerant in the aluminum fin material, into the fin tube type heat exchanger. Conventionally, copper tubes have been used as the heat transfer tube. However, due to the demands for weight saving, cost reduction, and improved recyclability, there is a need for substituting the copper tubes with aluminum alloy tubes.

Recently, improvement of the heat-transfer property is attempted in air conditioners for energy saving; and re-examining the kind of the refrigerant and improvement of the structural design of the heat exchanger are made. Under the circumstance, there is a demand for a heat transfer tube, which is one of components of the heat exchanger, having an even higher performance. Currently, inner grooved tubes, on the inner surface of which continuous spiral grooves are provided, are mainly used to improve the heat-transfer property.

As a method of producing an inner spiral grooved tube, a groove rolling method, in which a tube is drawn while spiral grooves are rolled in the inner surface of the tube, is known (Patent Literature 1 (PTL 1)). In the groove rolling method for the conventional copper tubes, spiral grooves are rolled on the inner surface of the tube by pressing the tube on a grooved plug, which is provided in the inner circumference of the tube, from the outer circumference of the tube by using a ball bearing rotating at a high speed. Similar groove rolling methods are planned to be used for producing an inner spiral grooved tube made of aluminum or aluminum alloy.

As an alternative method of producing an inner spiral grooved tube, a method, in which an inner spiral grooved tube with an twist angle is produced by: using a raw tube having straight grooves on the inner surface; and drawing the tube with a drawing die while the diameter of the tube is reduced with the drawing die concurrently with twisting the raw tube in front of the drawing die to form plastic flow in the reduced diameter portion of the raw tube, is known (Patent Literature 2 (PTL 2)).

As another alternative method of producing an inner spiral grooved tube, a method, in which an inner spiral grooved tube is produced by: winding a raw tube, on the inner surface of which straight grooves along a longitudinal direction of the raw tube are formed with an interval in the circumferential direction, in a coiled shape; and stretching the coiled shape raw tube in a straight tubeshape by applying a constant tension along the axis of the coil to introduce twist in the raw tube, is known (Patent Literature 3 (PTL 3)).

CITATION LIST

Patent Literature

PTL 1: Japanese Unexamined Patent Application, First Publication No. H06-190476 (A)

PTL 2: Japanese Unexamined Patent Application, First Publication No. H10-166086 (A)

PTL 3: Japanese Unexamined Patent Application, First Publication No. 2012-236225 (A)

SUMMARY OF INVENTION

Technical Problem

However, in producing an inner spiral grooved tube made of aluminum alloy, it is difficult to obtain a predetermined groove shape in the groove rolling method disclosed in PTL 1. Aluminum alloy has a lower strength than that of copper alloy. Thus, in order to obtain a sufficient pressure capacity of the inner spiral grooved tube, it is necessary for the bottom wall thickness of the tube to be thicker than that of the inner spiral grooved tube made of copper alloy. In this case, since plastic flow is difficult to be formed, rolling a predetermined inner groove shape, particularly so called "the high slim type fin" having a high fin height and a narrow fin width, is difficult. Thus, defects due to improper plastic flow, such as missing groove and the like, are likely to be formed. When the tube is processed forcedly, it buckles or ruptures. In addition, aluminum chip is formed by the grooved plug, which is provided in the inner circumference side of the tube, contacting on the inner circumference side of the tube. Due to aluminum chip formation, the accuracy of the groove shape during processing is reduced. In addition, the aluminum chip resides in the tube to clog a groove since it is difficult to remove it after the processing. Thus, there are problems having deteriorated heat-transfer property and increased pressure loss in the method disclosed in PTL 1. Furthermore, in the groove rolling method, variation in the groove shape is large. This is because of filling the inner circumference side of the tube with lubricant for groove rolling during inserting the floating plug in advance. The viscosity of the lubricant deteriorates and is reduced in processing for a long distance in the longitudinal direction of the coil. It causes differences of the bottom wall thickness and the groove shape of the produced inner spiral grooved tube between the head and the tail of the tube in the longitudinal direction. The variations in the bottom wall thickness and the groove shape effect on heat-transfer property. At the same time, they cause formation of variation in the tube expansion rate in an expanded tube for joining the fin and the inner spiral grooved tube.

Because of this, an alternative method other than this groove rolling method is needed for producing the inner spiral grooved tube made of aluminum alloy.

The production apparatus described in the above-mentioned PTL 2 has the configuration, in which the dispensing drum 102 is journaled by the rotation shaft 101 supported rotatably about the shaft and horizontally by the pair of columnar support parts 100; and the raw tube 103 is wound around the winding drum 106 after the raw tube 103 having been wound around the dispensing drum 102 in the coiled shape is drawn through the drawing die 105 as shown in FIG. 14.

On the inner surface of the raw tube 103, multiple straight grooves are formed; and the raw tube 103 having passed the drawing die 105 is shaped into the inner spiral grooved tube 108 having the spiral grooves on the inner surface.

In FIG. 14, the part 110 is a drive unit such as a motor or the like for rotating the rotation shaft 101. The output shaft of this drive unit 110 transmits rotational driving force to the rear end side of the rotation shaft 101 through the transmission part 111 such as the endless belt or the like. The drawing shown in FIG. 14 is a simplified one. The rotation shaft is constituted as a part of a frame; and the dispensing drum 102 is rotatably supported by the rotation axis 113 in the inside of the frame. On the front end side of the rotation shaft 101, a roller, which guides the raw tube 103 and is not depicted in the drawing, is provided. Through this roller, the traveling track of the raw tube 103 is changed; and the raw tube 103 can be drawn after performing axis alignment of the raw tube 103 to the drawing hole of the drawing die 105 provided on the table 115.

The production apparatus shown in FIG. 14 is known as an apparatus capable of producing an inner spiral grooved tube with a large twist angle by reducing the diameter of the tube while the raw tube is twisted with the drawing die 105 to form plastic flow in the reduced diameter part of the raw tube 103. However, buckling occurs on the raw tube 103 due to the action of twisting in the midstream: from the location, in which the raw tube 103 is dispensed from the dispensing drum 102; to the location reaching to the drawing die 105 in the production apparatus shown in FIG. 14. Thus, it is difficult to introduce a large twist angle. In other words, it has been difficult to balance actions of both forces of: twisting; and reducing the diameter of the tube, in the inside of the drawing die 105 properly. Because of this, the apparatus has a problem that torsional force is concentrated in the interposing part: from the location the raw tube 103 is dispense from the dispensing drum 102; to the location reaching to the drawing die 105, such as the location of the front end side of the rotation shaft 101 where the traveling track of the raw tube 103 is changed, the location in front of or after the above-mentioned location, and the like, for the raw tube 103 to be buckled easily before reaching to the die 105.

The production apparatus described in the above-mentioned PTL 3 is an apparatus of producing an inner spiral grooved tube having spiral grooves on the inner surface by forming a constant twist in an extruded tube, on the inner surface of which multiple straight grooves along the longitudinal direction of the raw tube are formed with an interval in the circumferential direction. The outline of the apparatus is shown in FIG. 16.

The production apparatus 120 shown in FIG. 16 includes: the winding part 123 winding the extruded raw tube 121, on the inner surface of which inner fins are formed by multiple straight grooves, on the circumference of the winding roll 122 in a coiled shape; the stretching part 130 stretching the coiled tube material 121*a* formed in the coiled shape in the extending direction toward the foreside of the coil axis 124 to shape it into a straight tube form; the drawing die, which corrects the sectional shape of the tube body after stretching and is not depicted in the drawing; and the heat treatment part heating the inner spiral grooved tube after correcting. Multiple stages of the production apparatuses 120 shown in FIG. 16 are used series-connected depending on the extent of the twist angle needed.

In the production apparatus 120, the feed roll 125, which feed the coiled tube material 121*a* to the outside of the winding roll 122 and the presser roll 126 are provided; and the guide plate 127 restricting the coiled tube material 121*a* is provided. A heater is built in a part of the presser roll 126; and the coiled tube material 121*a* can be heated to the temperature needed for processing (200° C. to 300° C.).

To the stretching part 130, the stretcher 128, which stretches the coiled tube material 121*a* by chucking, and multiple pinch controls, which shape the stretched tube material into a straight tubeshape while tension is placed on the tube material, are provided. After the processing, the inner spiral grooved tube 132 is wound around the winding roll 131

The extruded raw tube 121 having straight grooves on the inner surface is processed to be an inner spiral grooved tube 132 having spiral grooves on the inner surface and can be wound up by: processing the extruded raw tube 121 made of aluminum or aluminum alloy into the coiled tube material 121*a*; and stretching with the stretcher 128; and shaping the stretched tube material into a straight tubeshape by the pinch rolls 129, using the production apparatus 120 shown in FIG. 16, However, when the inner spiral grooved tube is produced by the production apparatus 120 shown in FIG. 16, the twist angle obtained depends on the diameter of the winding roll 122. Thus, when it is needed to obtain a large twist angle in a single processing, the diameter has to be small. However, a hollow tube is wound around a roll with a small diameter, it is possible that the tube is flattened or buckled. Thus, a process of winding around a roll with a large diameter and stretching the coiled tube material has to be repeated multiple times; and it is not productive. In addition, it has a problem that the production time becomes longer due to necessity of heat treatment process for removal of work-hardening since the tube work-hardens in the process for winding around the roll and the process for stretching.

In addition, not only the diameter of the roll for winding but also the pitch in being wound in the coiled shape significantly effects on the twist angle introduce as described above. However, processing a tube in a spring shape with a constant pitch is difficult. As a result, producing an inner spiral grooved tube by using the production apparatus 120 shown in FIG. 16 has a problem that there is large variety in the twist angle in the longitudinal direction of the tube; and a consistent twist angle cannot be introduced in the tube. Moreover, by repeating the above-described process multiple times, the variation of the twist angle is likely to be even larger.

The present invention is made under the circumstance described above. The purpose of the present invention is to provide a method of producing an inner spiral grooved tube and an apparatus for producing an inner spiral grooved tube, in each of which there is no formation of aluminum chip on the inner circumference in producing the inner spiral grooved tube; the dimensional accuracies of the groove shape and the twist angle are high in the longitudinal direction; an inner spiral grooved tube with a high height of fins is obtained; a large twist angle can be introduced; and productivity is high.

Solution to Problem

An aspect of the present invention is a method for producing an inner spiral grooved tube including the steps of: unwinding a raw tube from a drum to an unwinding side capstan while the raw tube is rotated around a central axis perpendicular to a winding shaft of the drum by rotating the drum and the unwinding side capstan about the central axis concurrently with unwinding of the raw tube from the drum holding the raw tube, on an inner surface of which multiple straight grooves along a longitudinal direction of the raw tube are formed with an interval in a circumferential direction, in a coil shape, to wind the raw tube around the unwinding side capstan; and twisting and drawing the unwound raw tube by introducing twist to the unwound raw tube while a diameter of the unwound raw tube is reduced by being passed through a drawing die, to obtain an inner spiral grooved tube.

By simply feeding the raw tube from the coil and passing it through the drawing die as it is as disclosed in the method disclosed in PTL 2, the distance of the processing zone of the raw tube unwound from the coil entering in the drawing die is long. Thus, kink is formed in such a way that the raw tube is locally bent in the interposing part; and buckling is likely to occur on the raw tube. Therefore, a large twist cannot be introduced in the method disclosed in PTL 2.

When an inner spiral grooved tube is produced by the method of producing an inner spiral grooved tube, which is an aspect of the present invention, the raw tube is wound around the unwinding side capstan in front of the drawing die; and the unwinding side capstan is rotated synchronizing to the rotation of the unwound side drum. Thus, the central axis of the processing zone introducing twist can be displaced from the unwinding track of the raw tube from the unwound side drum in the direction parallel to the rotation axis of the capstan to the extent corresponding to the number of turns of the tube wound around the capstan. In addition, the distance of the processing zone twisting the raw tube is set from the top location of the unwinding side capstan to the terminal end portion of the drawing die, and can be controlled to a constant value within a range of shorter values by the raw tube being wound around and held on the capstan. Therefore, a constant twist angle can be stably introduced in the longitudinal direction of the raw tube by controlling the unwinding speed of the raw tube and the rotation speed (revolution means the rotation of the unwinding side capstan about the axis of the processing zone) of the unwinding side capstan; and the diameter reduction ratio in drawing. At the same time, occurrence of buckling can be suppressed even in introducing a large twist angle in the process of a single unwinding by: adjusting the distance from the capstan in front of the drawing die to the drawing die to set the distance between them to be relatively short; and setting the diameter reduction ratio to a high value.

In addition, if there were a function introducing backward tension to the rotation of the drum with a brake device such as the powder brake and the like; and a function introducing forward tension to the rotation of the drum by providing the drawing side capstan, in unwinding the raw tube from the drum, appropriate tension could be stably introduced in the raw tube. Thus, slack in the path line of the raw tube is removed; and the raw tube enters in the drawing die without misalignment of the axis. As a result, occurrence of uneven thickness and buckling are prevented. In terms of the misalignment of the axis of the raw tube entering the drawing die, the effect of suppressing the misalignment of the axis can be obtained by holding the raw tube by both capstans in front of and in back of the drawing die.

The twist angle of the inner spiral grooved tube produced can be controlled based on the relationship between the drawing speed of the raw tube and the rotation speed of the unwinding side capstan. Under a constant drawing speed, the higher the rotation speed of the unwinding side capstan, the larger the twist angle.

In the method of producing the inner spiral grooved tube, which is an aspect of the present invention, there is no need to roll the groove by inserting the plug into a round tube as in the groove rolling method. Thus, by forming deep grooves in advance on the inner wall of the raw tube before twisting, the high slim fin type tube, which has a high height of fins and a narrow apex angle of the fins, can be produced highly accurately with ease in the method of the present invention. In addition, there is no need to clean the inner surface of the tube material to remove the residual lubricant oil after processing of the raw tube. Thus, the number of processes can be reduced.

The raw tube on which straight grooves are formed can be easily obtained by extruding, for example.

In the method of producing an inner spiral grooved tube, which is an aspect of the present invention, a diameter reduction ratio of the drawing die may be 5% to 40%.

By performing the drawing process and the twisting process at the same time, the maximum twist angle, which is the twist angle obtainable without occurrence of buckling, (hereinafter referred as the twist angle limit) can be set to a larger value. When only the twisting process is performed on the raw tubeshear stress is introduced in the circumferential tangential direction of the raw tube; and the raw tube is twisted. At that time, compressive stress acts in the longitudinal direction of the raw tube. The larger the twist angle, the higher the compressive stress. When this compressive stress exceeds the buckling stress under which buckling occurs, the tube ended up being buckled. Drawing is effective on reducing this compressive stress by introducing tensile stress in the longitudinal direction by drawing; and the occurrence of buckling can be suppressed.

In the testing performed by the inventors of the present invention, results, in which the larger the diameter reduction ratio, the more improved twist angle limit, are obtained.

If the diameter reduction ratio were too low, the effect of the tensile stress by drawing would be less, making it difficult to obtain a large twist angle. Thus, it is preferable that the diameter reduction ratio is set to 5% or more. On the other hand, if the diameter reduction ratio were too high, it would be possible that the raw tube is ruptured. Thus, it is preferable that the diameter reduction ratio is set to 40% or less.

In the method of producing an inner spiral grooved tube, which is an aspect of the present invention, a foremost location, on which the raw tube is wound around the unwinding side capstan; and a foremost location, on which the raw tube is sent from the unwinding side capstan to a side of the drawing die, may be displaced in a direction parallel to a rotation axis of the unwinding side capstan for an interspace between the unwinding side capstan and the drawing die to be a twist processing zone of the raw tube.

In the method of producing an inner spiral grooved tube, which is an aspect of the present invention, forward and backward tension may be introduced in the raw tube during reducing the diameter of the raw tube with twisting by passing the raw tube through the drawing die.

In the method of producing an inner spiral grooved tube, which is an aspect of the present invention, the inner spiral grooved tube passing through the drawing die may be wound around a drawing side capstan.

In the method of producing an inner spiral grooved tube, which is an aspect of the present invention, the inner spiral grooved tube unwound from the drawing side capstan may be shaped into a form with a second drawing die.

In the method of producing an inner spiral grooved tube, which is an aspect of the present invention, the raw tube unwound from the drum may be shaped into a perfect circle shape with the drawing die before the raw tube reaches to the unwinding side capstan.

In the method of producing an inner spiral grooved tube, which is an aspect of the present invention, the raw tube may be an extruded raw tube made of aluminum or aluminum alloy.

Other aspect of the present invention is an apparatus for producing an inner spiral grooved tube including: a drum holding a raw tube, on an inner surface of which multiple straight grooves along a longitudinal direction of the raw tube are formed with an interval in a circumferential direction; an unwinding side capstan unwinding the raw tube unwounded from the drum while the unwounded raw tube is wounded around the unwinding side capstan; a rotation part rotating the drum and the unwinding side capstan centering on a central axis perpendicular to a winding shaft of the drum; and a drawing die reduces a diameter of the raw tube and introduces twist on the raw tube by passing the raw tube unwound from the unwinding side capstan thorough the drawing die.

In the apparatus for producing an inner spiral grooved tube, which is other aspect of the present invention, a foremost location, on which the raw tube is wound around the unwinding side capstan; and a foremost location, on which the raw tube is sent from the unwinding side capstan to a side of the drawing die, may be displaced in a direction parallel to a rotation axis of the unwinding side capstan for an interspace between the unwinding side capstan and the drawing die to be a twist processing zone of the raw tube.

In the apparatus for producing an inner spiral grooved tube, which is other aspect of the present invention, the apparatus may be configured to introduce backward tension in the raw tube on a side in front of the drawing die by restricting rotation of the drum.

In the apparatus for producing an inner spiral grooved tube, which is other aspect of the present invention, the apparatus may be configured to introduce forward tension in the inner spiral grooved tube by unwinding the inner spiral grooved tube by winding the inner spiral grooved tube on a side after the drawing die.

The apparatus for producing an inner spiral grooved tube, which is other aspect of the present invention, may further includes a second drawing die shapes the inner spiral grooved tube on a side after the drawing side capstan.

The apparatus for producing an inner spiral grooved tube, which is other aspect of the present invention, may further includes a drawing die shaping the raw tube into a perfect circle shape on a side before the unwinding side capstan.

If a capstan were provided in each of the front and the back of the drawing die; and the raw tube were wound around each capstan, the central axis of the processing zone introducing twist could be displaced in the direction parallel to the rotation axis of the capstan from the winding shaft of the drum or the like to the extent corresponding to the number of turns of the tube wound around the capstan. In addition, the distance of the processing zone of the raw tube could be set from the top location of the unwinding side capstan to the terminal end portion of the drawing die, and could be controlled to a constant value. At the same time, there would be no rotation of the inner spiral grooved tube after the terminal end portion of the drawing die since the inner spiral grooved tube is wound around and held on the unwinding side capstan. Thus, there is no abrasion scratch between the inner spiral grooved tubes since the raw tube can be wound around the winding drum without rotation.

In addition, in the apparatus for producing an inner spiral grooved tube, which is other aspect of the present invention, each of the unwinding side capstan and the drawing side capstan may be provided with a driven roller, which is configured to be wrapped around by the raw tube or the inner spiral grooved tube in such a way that the raw tube or the inner spiral grooved tube hangs around the driven roller between: the each of the unwinding side capstan and the drawing side capstan; and the driven roller, and the driven roller may be placed on a location withdrawn from a travel lane of the raw tube or the inner spiral grooved tube.

By arranging the driven roller withdrawn from the travel lane, the twisting processing zone between capstans can be set in a short distance. Thus, occurrence of buckling can be suppressed effectively.

When the driven roller is provided, overlapping of each of the raw tubes could be prevented if it were arranged in the intersecting direction to the central axis of the capstan. As a result, formation of the surface scratch; rupturing; and occurrence of buckling on the produced inner spiral grooved lube can be suppressed effectively.

Advantageous Effects of Invention

According to the present invention, the raw tube used is not limited to one made of aluminum alloy particularly; and can be used for one made of other metal such as copper alloy and the like. In the present invention, the inner grooves of raw tube, which has grooves on the inner surface, such as the electric weld tube and the like, can be used. In the electric weld tube and the like, an extruded material or a plate material on which grooves are formed by pressing is processed into a round shape by the roll forming process and the junctions are welded. Thus, the degree of freedom and the dimensional accuracy of the shape of inner surface grooves of the produced inner spiral grooved tube are high.

In addition, an inner spiral grooved tube having a high height of fins and a narrow apex angle of the fins can be obtained. Furthermore, the present invention can be applied to a fine tube (thinning); and a large twist angle of 35° or more can be introduced.

These effects are attributed to abilities of: setting the region, in which the twisting process in the longitudinal direction of the raw tube is loaded, short by passing the raw tube through the drawing die after having the unwinding side capstan revolve first; and overlapping the twist processing zone and the diameter reduction processing zone to the processing zone of the drawing die as much as possible.

In addition, the raw tube can reach to the drawing die without introducing twist to the raw tube in the interposing part between the drum and the unwinding side capstan by synchronously rotating both of: the drum unwinding the raw tube; and the unwinding side capstan with the revolving raw tube, around the same axis to unwind the raw tube to the side of the drawing die. Thus, the twist processing and the diameter reduction processing of the raw tube can be performed while buckling of the raw tube is suppressed.

Furthermore, there is no chip formation, such as the aluminum chip and the like, on the inner surface of the produced inner spiral grooved tube. Thus, the twist angle, the height of fins, and the bottom wall thickness are stable in the longitudinal direction. Therefore, it does not have an adverse effect on expansion of the tube in assembling of the heat exchanger.

DESCRIPTION OF EMBODIMENTS

Embodiments of the apparatus for producing an inner spiral grooved tube related to the present invention and the method of producing an inner spiral grooved tube using the apparatus are explained below in reference to the drawings.

Figure 5A:
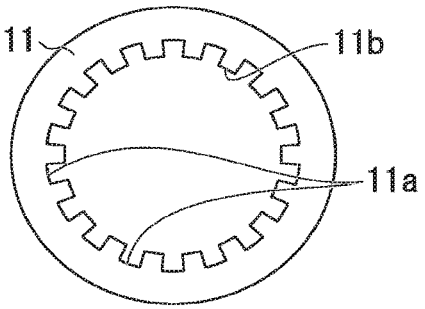
FIG. 5A is a front view showing the raw tube having straight grooves formed on its inner surface.
Figure 5B:
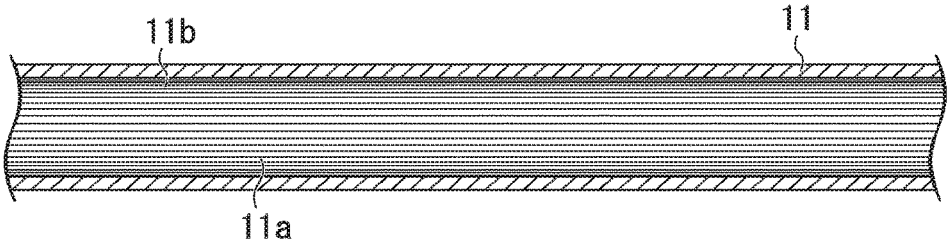
FIG. 5B is a side sectional view showing the raw tube having straight grooves formed on its inner surface.
Figure 6:
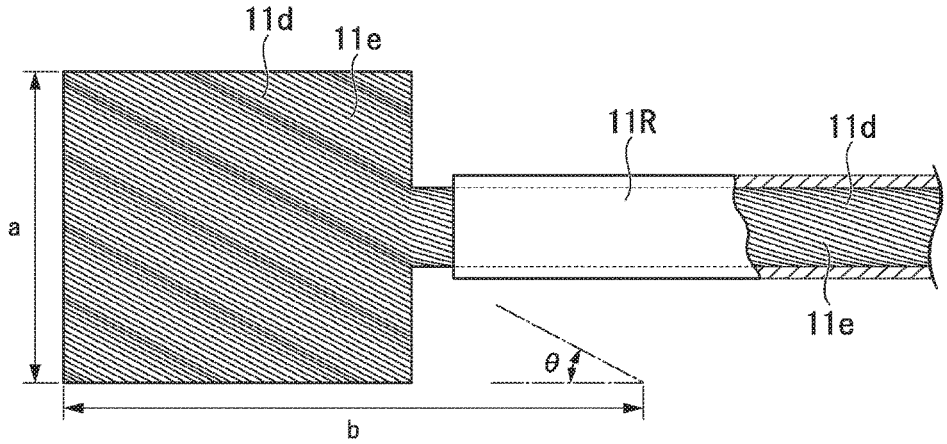
FIG. 6 is an explanatory view showing a cross section and a partly unfolded state of the tube with the inner spiral grooves in which spiral grooves are formed on the inner surface.

The production apparatus A for the inner spiral grooved tube of the present embodiment is an apparatus producing the inner spiral grooved tube 11R (FIG. 6) having the spiral grooves on the inner surface by introducing a constant twist on the raw tube 11 (refer FIGS. 5A and 5B), on the inner surface of which multiple straight grooves 11*a* along the longitudinal direction are formed with an interval in the circumferential direction.

Figure 1:
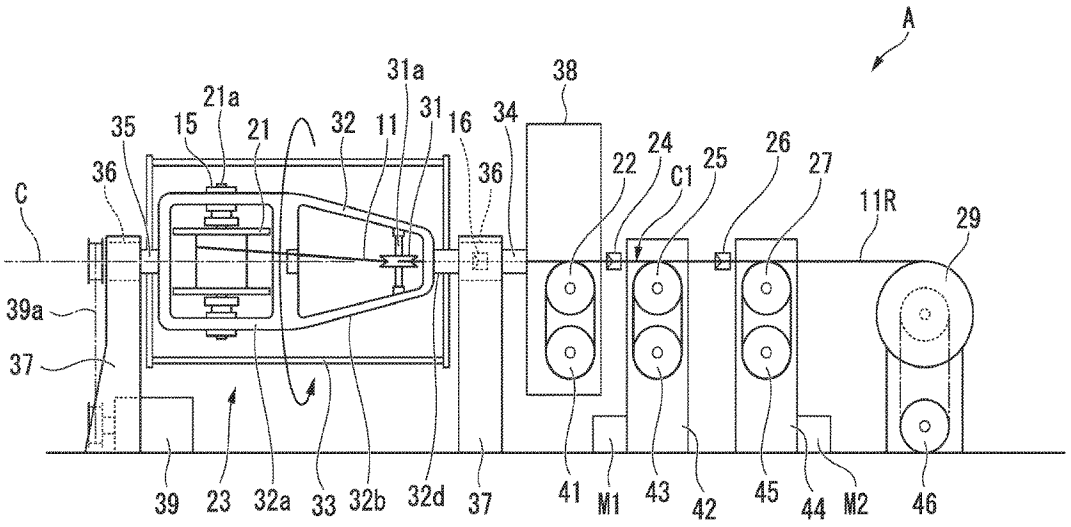
FIG. 1 is a schematic view showing an embodiment of the apparatus for producing an inner spiral grooved tube according to the present invention.

As shown in FIG. 1, the production apparatus A includes: the drum 21 holding the raw tube 11, on the inner surface of which fins 11*b* are formed by the straight grooves 11*a*, in the state where the raw tube 11 is wound in the coiled shape; the unwinding side capstan 22, which unwinds the raw tube 11, while the raw tube 11 unwound from the drum 21 is wound around the unwinding side capstan 22; the rotation part 23 rotating the drum 21 and the unwinding side capstan 22 around the central axis C perpendicular to the winding shaft 21*a* of the drum 21; the drawing die 24, through which the raw tube 11 fed from the unwinding side capstan 22 passes; the drawing side capstan 25 feeding out the inner spiral grooved lube 11R, in which the straight grooves on the inner surface became spiral grooves by passing through the drawing die 24 while the inner spiral grooved tube 11R is wound around the drawing side capstan 25; the second drawing side die 26, through which the inner spiral grooved tube 11R having gone through the drawing side capstan 25 passes; the third capstan 27 around which the inner spiral grooved tube 11R having gone through the second drawing side die 26 is wound; and the winding drum 29 winding the inner spiral grooved tube 11R, which is unwound from the third capstan 27, around.

The drum 21 on the unwinding side (hereinafter referred as the unwound side drum) is mounted on the first frame 32 with the guide pulley 31, which guides the unwound raw tube 11 along the central axis C, and the support shaft 31*a*. In this setup, the unwound side drum 21 is supported rotatably by the first frame 32 and feeds out the raw tube 11 with a constant tension controlling the braking force by the winding diameter. The reference symbol 33 indicates the cover enclosing the unwound side drum 21, the guide pulley 31 and the like on the whole. In the structure shown in FIG. 1, the braking force of the drum 21 is generated by the braking device 15 such as the powder brake or the like, which is provided so as to be connected to the rotation axis 21*a* and capable of adjusting the torque freely The front end portion 34 and the read end portion 35 of the first frame 32 extend along with the central axis C axially. The front end portion 34 and the read end portion 35 are supported horizontally and rotatably around the central axis by the pair of the leg parts 37 through the bearings 36 for the first frame 32 to be rotatable. The front end portion 34 of the first frame 32 protrudes from the leg part 37 in the forward direction; and the second frame 38, which holds the unwinding side capstan 22, is fixed on the protruding portion. Therefore, the second frame 38 is kept in the state where it is fixed on the first frame 32, and rotatably supported around the central axis C along with the unwinding side capstan 22.

The first frame 32 includes: the main frame 32*a*, which supports the rotation axis 21*a* of the drum 21 and is in a rectangular frame shape; the sub frame 32*b* in an isosceles shape extendedly formed in a tapered-off shape from a side of the main frame 32*a* in the side view; the front end portion 34 in an axis shape extendedly formed on the front end side of the sub frame 32*b*; and the read end portion 35 in an axis shape extendedly formed on the rear end side of the main frame 32*a*.

The front end portion 34 of the first frame 32 protrudes further from the other leg part 37 in the forward direction; and the second frame (unwinding side fame) 38, which holds the unwinding side capstan 22, is fixed on the protruding portion. Therefore, the second frame 38 is integrated to the first frame 32, and rotatably supported around the central axis centering on the horizontal central axis C along with the unwinding side capstan 22.

The rear end portion 35 of the first frame 32 protrudes from the leg part 37 in the backward direction; and the drive unit 39 such as a motor and the like is provided below the protruding portion. An end of the transmission part 39*a* such as the endless belt or the like is wrapped around on the rotation shaft of the drive unit 39; and the other end of the transmission part 39*a* is wrapped around on the protruding portion of the rear end portion 35. Because of this, the rotation force of the rotation shaft of the drive unit 39 is transmitted to the protruding portion of the rear end portion 35; and the first frame 32 and the second frame 38 can be rotated.

Thus, it is configured that the first fame 32 and the second frame 38 are rotated as a single piece by the drive unit 39. The rotation part 23, which rotates the unwound side drum 21 and the unwinding side capstan 22 as a single piece around the central axis C, is constructed from: the drive unit 39; the first and second frames 32, 38; the bearings 36; the leg parts 37; and the like.

Figure 3:
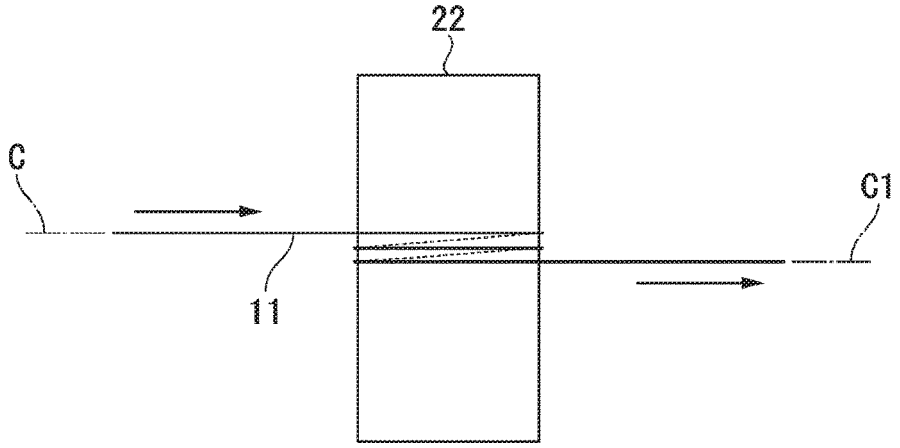
FIG. 3 is a plan view schematically showing the winding state of the raw tube with respect to the unwinding side capstan of the production apparatus.

In the example shown in the drawing, the unwinding side capstan 22 has the driven roller 41. The unwinding side capstan 22 re-feeds the raw tube 11 along the central axis C in the state where the raw tube 11 is wound around the unwinding side capstan 22 so as the raw tube 11 to be wrapped around several turns between the unwinding side capstan 22 and the driven roller 41. The raw tube 11 is fed out along the central axis C1 (the central axis of the processing zone, which is described later), which is displaced from the unwinding track from the unwound side drum 21 in the direction parallel to the rotation axis of the capstan 27 as shown in FIG. 3, by being wound around the capstan 22 several turns. Since the raw tube 11 is wound around several turns, the raw tube 11 is unwound from the capstan 22 with a stable tension.

Figure 2:
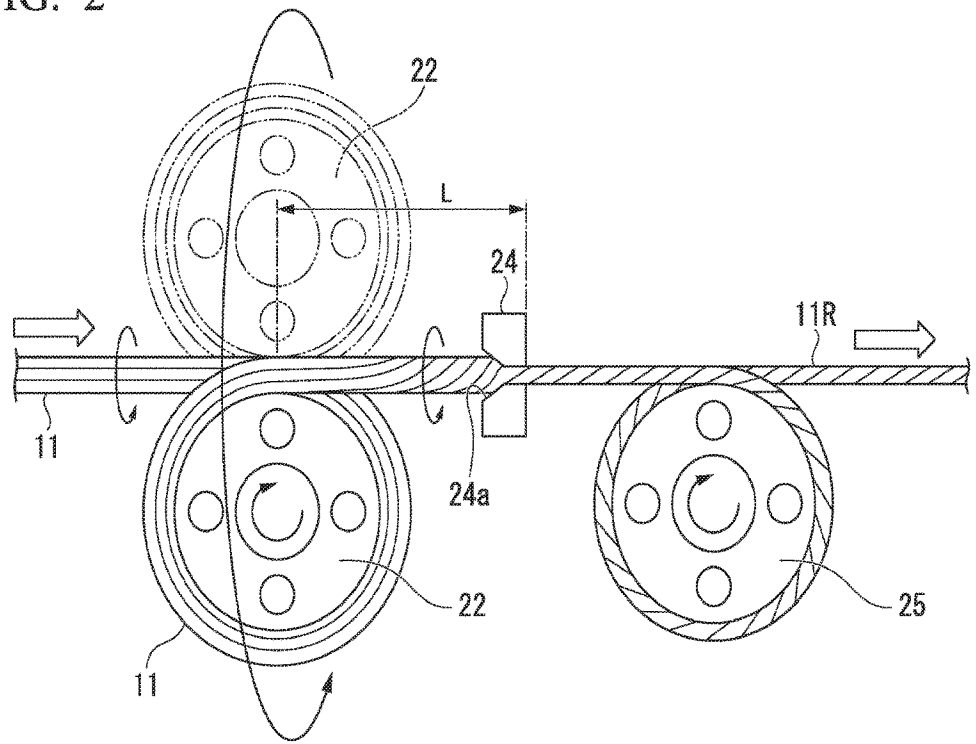
FIG. 2 is an explanatory diagram showing an enlarged main part of the production apparatus.

FIG. 2 is a drawing mainly depicting the relative relation of: the unwinding side capstan 22 and the drawing side capstan 25, which are provided in front of or in back of the drawing die 24; and the raw tube 11, among the production apparatus A shown in FIG. 1. Thus, depiction of the driven rollers 41, 43 is omitted in FIG. 2.

In addition, the processing zone is defined as the distance L, which is the distance between the top portion of the capstan 22 and the exit part of the drawing die 24, as shown in FIG. 2.

In this case, the driven roller 41 is provided in the location withdrawn from the central axis C (traveling track of the raw tube 11). In the example shown in the drawing, the driven roller 41 is arranged to be vertical to the central axis C (traveling track of the raw tube 11) from the unwinding side capstan 22. In addition, the capstan 22 and the driven roller 41 are not arranged in parallel; and the central shaft of the driven roller 41 is arranged in the direction intersecting with the direction of the central shaft of the capstan 22. By being arrange in this way, overlapping of the pieces of the raw tube, which are wound around them, can be prevented. Thus, formation of the surface scratch; rupturing; and occurrence of buckling on the produced inner spiral grooved tube can be suppressed effectively.

In addition, the production apparatus A includes the drawing die 16, which recovers the roundness on the raw tube 11 before the twist processing, in the bearing 36 in the leg part 37.

The raw tube 11 wound in the coiled shape is deformed in a flat shape due to contacting with each of raw tubes. When drawing is performed in the deformed shape, the flat raw tube 11 does not contact with the drawing die 24 evenly, and is buckled by introduction of twist. Thus, drawing in 0.5% to 3% of the dimension reduction ratio is performed in order to obtain the circularity, in which the short diameter/long diameter ratio is 1.2 or less. The diameter reduction ratio can be obtained from the percentage of ((the outer diameter of the raw tube 11 before drawing)−(the outer diameter of the inner spiral grooved tube after drawing))/(the outer diameter of the raw tube 11 before drawing).

The drawing die 24 is provided above the central axis C1 in such a way that the raw tube 11 immediately after being unwound from the unwinding side capstan 22, passes through the drawing die 24. Specifically, the drawing side capstan 25 is arranged in the state where the unwinding side capstan 22 and the traveling track of the raw tube 11 are aligned to the central axis C1; and the drawing die 24 is provided between the capstans 22, 25. The drawing side capstan 25 rotates by motor drive. In this setup, the drawing side capstan 25 is supported by the table 42. The drawing die 24 is fixed on the front end portion of the table 42 integrally.

The drawing side capstan 25 has the driven roller 43 similar to the unwinding side capstan 22. The drawing side capstan 25 feeds the raw tube 11 in the direction parallel to the central axis C1 in the state where the inner spiral grooved tube 11R is wound around the drawing side capstan 25 so as the inner spiral grooved tube 11R to be wrapped around several turns between the drawing side capstan 25 and the driven roller 43.

The inner spiral grooved tube 11R is wound around the drawing side capstan 25 several turns. The inner spiral grooved tube 11R is fed to the drawing side capstan 25 displaced from the central axis C between the capstans 22, 25 in the direction parallel to the rotation shaft of the capstan 25

As in the case in the unwinding side capstan 22, the driven roller 43 is provided in the location withdrawn from the central axis C1 (traveling track of the inner spiral grooved tube 11R) too. The driven roller 43 is arranged to be vertical to the central axis C1 (traveling track of the inner spiral grooved tube 11R) from the drawing side capstan 25. Thus, the distance between the drawing side capstan 25 and the unwinding side capstan 22 in the upstream is shortened; and the twist processing zone in between becomes short. As a result, occurrence of buckling on the produced inner spiral grooved tube 11 R can be suppressed effectively.

Figure 4:
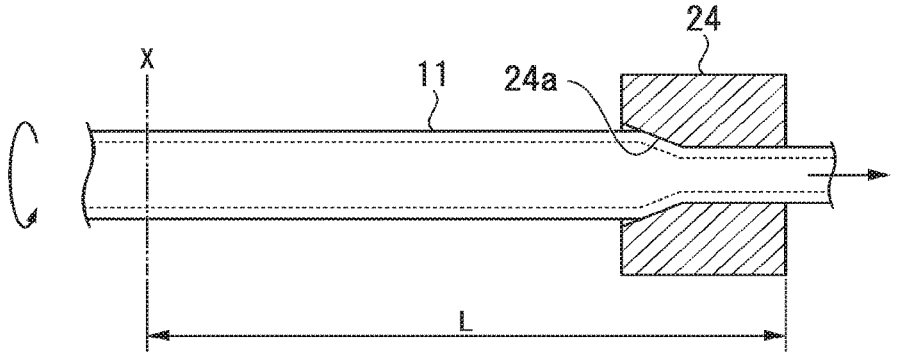
FIG. 4 is a cross-sectional view of the drawing die used in the production apparatus.

The drawing die 24 has the die hole 42*a*, through which the raw tube 11 passes, as shown in FIG. 4; and empty drawing for reducing the outer diameter of the raw tube 11 is performed. The diameter reduction ratio in the drawing die 24 is set to 5% to 40%. If the diameter reduction ratio were too low, the effect obtained by drawing would be insufficient, making it difficult to obtain a large twist angle. Thus, it is preferable that the diameter reduction ratio is 5% or more. On the other hand, if the diameter reduction ration were too high, rupturing of the tube would be likely to occur due to exceeding the processing limit. Thus, it is preferable that the diameter reduction ratio is 40% or less.

In the present embodiment, the third capstan 27, which is supported by the table 44, is provided on the location downstream to the drawing side capstan 25. The second drawing die 26 is provided between the drawing side capstan 25 and the third capstan 27. The third capstan 27 rotates by motor drive. The second drawing die 26 is provide for skin passing of the inner spiral grooved tube 11R, which is produced by being passed through the drawing dice 24 in the previous step. The change of the dimension reduction ratio in the second drawing die 27 is less. By passing through the second drawing die 27, the surface and the dimension are subjected to the finishing shaping; and the roundness of the inner spiral grooved tube 11R is recovered.

The third capstan 27 is configured similar to the above-described other capstans 22, 25. The inner spiral grooved tube 11R is unwound in the state where the inner spiral grooved tube 11R is wound around the third capstan 27 so as t the inner spiral grooved tube 11R to be wrapped around several turns between the third capstan 27 and the driven roller 45. The driven roller 45 is configured similar to the other driven rollers 41, 43 in that: the driven roller 45 is arranged displaced from the central axis C (traveling track of the raw tube 11); and the driven roller 45 is arranged to be vertical to the central axis C (traveling track of the raw tube 11) from the third capstan 27.

The winding drum 29 is for winding the inner spiral grooved tube 11R with a constant tension, and has the drive unit 46 for its rotation.

Next, the method of producing the inner spiral grooved tube 11R by using the production apparatus A configured as described above is explained.

The raw tube 11, on the inner surface of which multiple straight grooves 11*a* along the longitudinal direction are formed with an interval in the circumferential direction, is produced by extrusion in advance as shown in FIG. 4 (the raw tube extruding process).

Then, the raw tube 11 is held on the unwound side drum 21 in the coiled shape. The raw tube 11 is unwound from the unwound side drum 21 rotating the raw tube 11 by rotating the unwound side drum 21 and the unwinding side capstan 22 around the central axis C along with the frames 32, 38 by the rotation part 23 while the raw tube 11, which is unwound from the unwound side drum 21, is wound around the unwinding side capstan 22 (the raw tube unwinding process).

The diameter of the raw tube 11 is reduced by performing the drawing processing by winding the raw tube 11 around the drawing side capstan 25 after the unwound raw tube 11 passes the drawing die 24 (the raw tube drawing process). By the raw tube drawing process, twist is introduced in the raw tube 11; and it is turned into the inner spiral grooved tube 11R, on the inner surface of which spiral grooves are formed.

In this case, shearing stress is placed on the raw tube 11 in the circumferential tangential direction by twisting to introduce the twist angle. Simultaneously, compressive stress accompanying the twist is placed in the longitudinal direction of the raw tube 11. When the value of the compressive stress exceeds the buckling stress, buckling occurs. However, the compressive stress can be reduced by the tensile stress in the longitudinal direction of the raw tube in the drawing process. Thus, occurrence of buckling can be suppressed.

The raw tube 11 or traveling track of the raw tube 11 is wound around each of the capstans 22, 25 provided in front of and in back of the drawing die 24. Thus, the central axis C1 of the processing zone introducing twist is displaced from the winding shaft of the drum and the winding shaft of the final winding drum in the direction parallel to the rotation axis of the capstan 22 from the winding shaft of the drum or the like to the extent corresponding to the number of turns of the tube 11 wound around the unwinding side capstan 22. In addition, by the raw tube 11 being wound around and held on the capstans 22, 25 in front of and in back of the drawing die 24, the distance of the processing zone of the raw tube 11 is defined as the distance L: from the top location of the unwinding side capstan; to the terminal end portion of the drawing die, as shown in FIG. 4, the distance L can be controlled to a constant value. The longer the processing zone, the smaller the buckling stress. Thus, when the processing zone is long, buckling is likely to occur even in a small twist angle introduction. By adjusting the distance between the capstans 22, 25 and setting the distance as short as possible, occurrence of buckling can be suppressed even in introducing a large twist angle.

If the location of the drawing side capstan 25 were too far away from the terminal end portion of the drawing die 24, the force holding the inner spiral grooved tube 11R would become low even if it is wound around the capstan 25; and the inner spiral grooved tube 11R would rotate even after passing through the drawing die 24. In this case, the distance of the processing zone in the longitudinal direction varies, causing variation of the twist angles in the longitudinal direction.

If the distance between both capstans 22, 25 were set too narrow, the capstans 22, 25 would contact the table 42 supporting the drawing die 24. Thus, it is preferable that the distance is set to narrow but in the range being able to avoid the contact between the capstans 22, 25 and table 42. It is preferable that the diameters of both capstans 22, 25 are set to 100 mm or more. If they were less than 100 mm, it would be possible that the raw tube is buckled or flattened in winding around each of both capstans 22, 25. On the other hand, if they were 900 mm or more, it would be possible that buckling occurs due to too wide distance between the capstans 22, 25, as explained above.

The twist angle of the inner spiral grooved tube is set based on the relationship between the rotation speed of the unwinding side capstan 22 and the unwinding speed of the raw tube 11.

The surface of the inner spiral grooved tube 11R is subjected to the finishing shaping by unwinding the inner spiral grooved tube 11R formed by the drawing process from the drawing side capstan 25; and inserting the inner spiral grooved tube 11R into the second drawing die 26 between the both capstans 25, 27 while the inner spiral grooved tube 11R is wound around the third capstan 27 (the finishing drawing process). Even in the case where deformation, such as some collapse and the like, was formed on the inner spiral grooved tube 11R in the raw tube drawing process, by going through this finishing drawing process, the deformation can be corrected to obtain the inner spiral grooved tube 11R having a predetermined roundness.

Finally, the inner spiral grooved tube 11R is wound around the winding drum 29 (the winding process).

The winding drum 29 rotates by motor drive synchronizing with the drawing side capstan 25 and the capstan 27.

As described above, the inner spiral grooved tube 11R having a large twist angle can be produced without occurrence of buckling by performing the drawing process rotating the raw tube 11 in the state where a constant tension is placed between the unwinding side capstan 22 and the drawing side capstan 25. Particularly, there is no need to perform the groove rolling method, in which the plug or the like is inserted inside. Thus, by forming the fins 11*b* having a high height and a narrow apex angle on the inner surface of the raw tube 11 in extrusion work in advance, the raw tube 11 can be twisted without crushing the fins 11*b*. In addition, the slim fin type inner spiral grooved tube 11R can be produced; and there is no need for cleaning the inner surface of the tube material after the processing particularly.

Figure 7A:
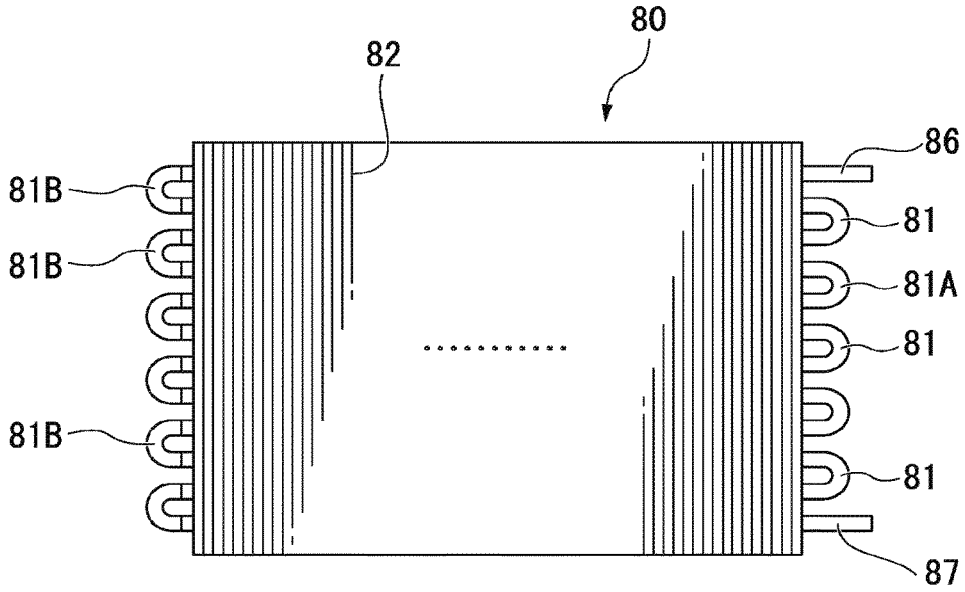
FIG. 7A is a side view showing an example of a heat exchanger having the tube with the inner spiral grooves according to the embodiment.
Figure 7B:
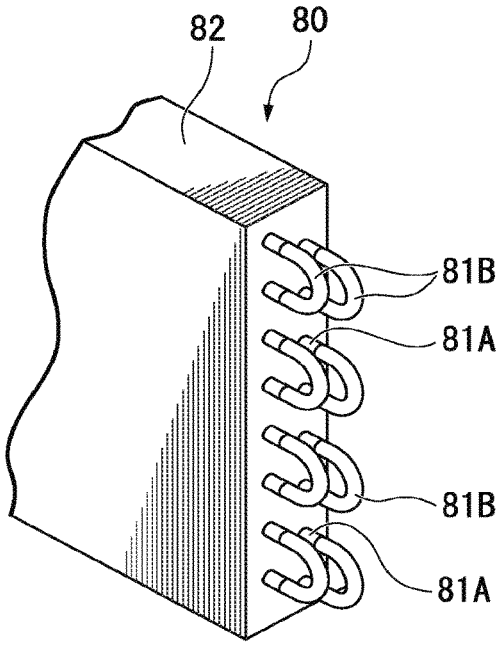
FIG. 7B is a perspective view showing an example of a heat exchanger having the tube with the inner spiral grooves according to the embodiment.

FIGS. 7A and 7B are schematic drawings showing an example of the heat exchanger 80 having the inner spiral grooved tube 11R related to the present invention. The heat exchanger 80 has the structure in which the inner spiral grooved tube 81 is provided meanderingly as the tube for running the refrigerant; and multiple fin materials 82 made of aluminum alloy are provided in parallel around the inner spiral grooved tube 81. The inner spiral grooved tube 81 is provided so as to pass through the multiple through holes, which are provided to penetrate through the fin materials 82 provided in parallel.

In the structure of the heat exchanger 80 shown in FIGS. 7A and 7B, the inner spiral grooved tube 81 is made by connecting adjacent end openings of adjacent multiple U shaped main tubes 81A, which penetrate through the fin materials 82 in a straight shape, with the U shaped elbow tube 81B each other as shown in FIG. 7B. The heat exchanger 80 shown in FIGS. 7A and 7B is configured by having: the inlet of refrigerant 86 formed on an end side of the inner spiral grooved tube 81 penetrating through the fin materials 82; and the outlet of refrigerant 87 formed on the other end side of the inner spiral grooved tube 81.

The heat exchanger 80 shown in FIGS. 7A and 7B is assembled by mechanically integrating the inner spiral grooved tube 81 and the fin materials 82 by: providing the inner spiral grooved tube 81 so as to penetrate through the through holes formed in each of the fin materials 82; and expanding the outer diameter of the inner spiral grooved tube 81 by an expansion plug after having them penetrate through the through holes of the fin materials 82.

By adapting the inner spiral grooved tube 81 to the heat exchanger 80 shown in FIGS. 7A and 7B, the heat exchanger 80 having excellent heat exchange efficiency can be provided.

In addition, for example, when the heat exchanger 80 is configured by using the inner spiral grooved tube 11R, which has a narrow outer diameter of 10 mm or less and is made of aluminum or aluminum alloy, the down-sized high-performance heat exchanger with excellent recyclability can be provided, since there is no need for the fin materials 82 and the inner spiral grooved tube 81 to be separated in recycling process.

EXAMPLES

Example 1

The inner spiral grooved tube was produced by using the raw tube made of 3003 aluminum alloy, on the inner surface of which straight grooves having the dimension of: 10 mm of the outer diameter; and 9.1 mm of the inner diameter, were formed.

As the raw tube, the extruded material made of 3003 aluminum alloy and having the dimension of: 10 mm of the outer diameter; and 9.1 mm of the inner diameter, was used as it was extruded. The number of straight grooves on the inner surface was 45 (8°/a protrusion). The height of the fins formed by these straight grooves was 0.28 mm; and the apex angle of the fins was 10°. By using this raw tube, the drawing process was performed in the condition of: 7.5 mm of the pore size of the drawing die; 25% of the diameter reduction ratio; and 5 m/min of the drawing speed.

Figure 8:
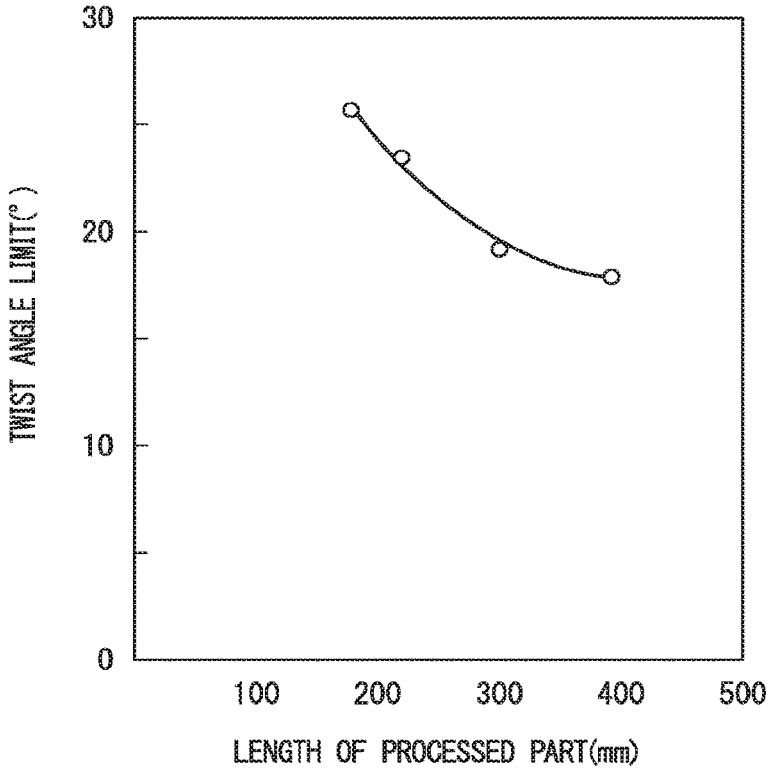
FIG. 8 is a graph showing the relationship between the distance of the processing zone and the twist angle limit when the inner spiral grooved tube is produced in Example of the present invention.

First, the distance of the processing zone and the rotation speed of the unwinding side capstan were increased to investigate their relationship with the twist angle limit (the maximum twist angle without occurrence of buckling); and results shown in FIG. 8 were obtained.

As shown in FIG. 8, there was correlation between them. It showed tendency that the value of the twist angle limit was increased exponentially accompanying with decrease of the distance of the processing zone. When the distance of the processing zone was 180 mm, buckling did not occur, which was a reference data.

The inner spiral grooved tube, which was produced in the above-described condition with the processing zone length of 220 mm, had: the outer diameter of 7.5 mm; and the spiral grooves formed on the inner surface with the twist angle of 30° after the raw tube drawing process. After the finish drawing process, the twist angle became a bit smaller by passing through the third drawing die, and ended up with the outer diameter being 7.7 mm and the twist angle of the inner spiral groove being 28° in the end.

In addition, the rotation speed of the unwinding side capstan was changed; and effects of the diameter reduction ratio during drawing on the twist, angle limit (the maximum twist angle without occurrence of buckling) were investigated in the condition of 220 mm of the processing zone distance; and 5 m/min of the drawing speed, by using the raw tube made of 3003 aluminum alloy with the outer diameter of ϕ10 and the inner diameter of ϕ9.1, on the inner surface of which straight grooves were provided. Results shown in FIG. 9 were obtained.

Figure 9:
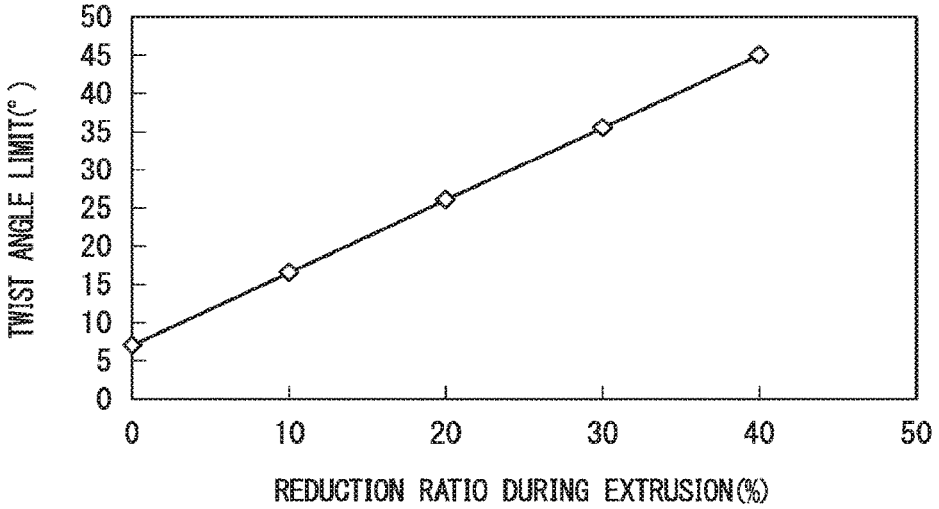
FIG. 9 is a graph showing the relationship between the diameter reduction ratio in drawing and the twist angle limit when the inner spiral grooved tube is produced in Example of the present invention.

As shown in FIG. 9, there was correlation between them. It showed tendency that the twist angle limit was increased accompanying with increase of the diameter reduction ratio in drawing.

Next, the relationship between the twist angle in drawing and the rotation speed of the frame on the unwinding side was investigated by using: the extruded raw tube made of 3003 aluminum alloy with the outer diameter of ϕ=10 mm and the inner diameter of ϕ=9.1 mm, on the inner surface of which straight grooves were provided; and the apparatus shown in FIG. 1. Results shown in FIG. 10 were obtained.

Figure 10:
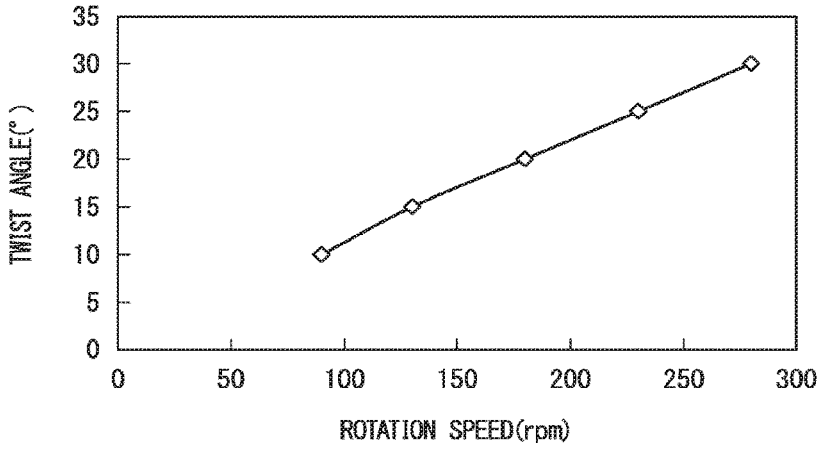
FIG. 10 is a graph showing the relationship between the rotation speed of the unwinding side capstan and the twist angle when the inner spiral grooved tube is produced in Example of the present invention.

FIG. 10 shows the relationship between the twist angle and the rotation speed of the unwinding side capstan in the condition of: 220 mm of the processing zone distance; 30% of the diameter reduction ratio; ϕ7.5 mm of the outer diameter; ϕ6.6 mm of the inner diameter; and the 10 m/min of the drawing speed.

The rotation speed of the unwinding side frame and the twist angle had proportional relationship. It was demonstrated that the twist angel could be modulated by changing the rotation speed of the unwinding side frame

Example 2

Next, the inner spiral grooved tube having the inner spiral grooves of 20° in the length of 778 m was produced in the production condition of: 220 mm of the processing zone distance; 30% of the diameter reduction ratio; 10 m/min of the drawing speed; 180 rpm of the rotation speed of the unwinding side capstan; ϕ7.5 mm of the outer diameter; and 06.6 mm of the inner diameter, by using: the raw tube made of 3003 aluminum alloy with the outer diameter of ϕ=10 mm and the inner diameter of ϕ=9.1 mm, on the inner surface of which straight grooves were provided; and the apparatus shown in FIG. 1. Apart of the inner spiral grooved tube was cut out in the length of 5 m; and distribution of the twist angles in the longitudinal direction of the cut out inner spiral grooved tube was investigated. Results shown in FIG. 11 were obtained.

Figure 11:
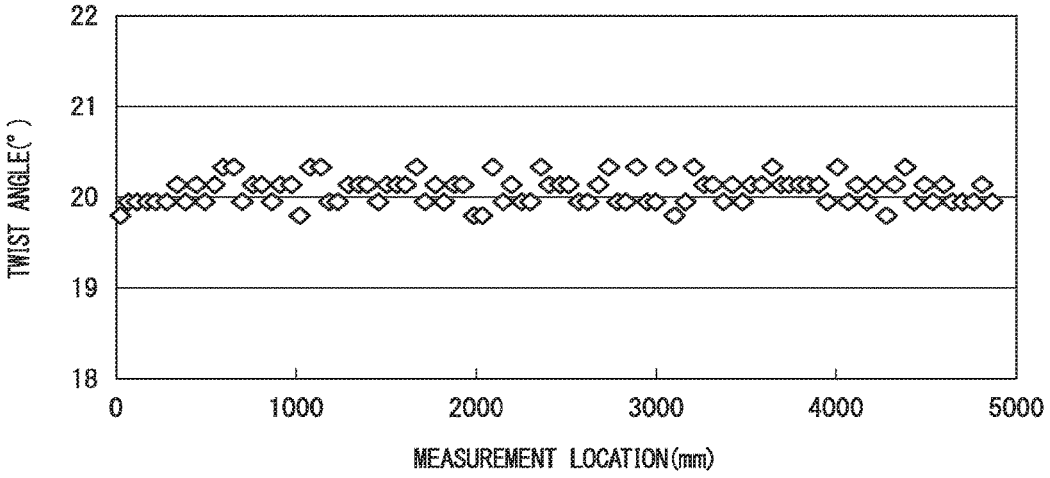
FIG. 11 is a graph showing the relationship between the measurement location in the longitudinal direction and the twist angle in an example of the inner spiral grooved tube produced in Example of the present invention.

Based on the results shown in FIG. 11, it was demonstrated that the twist angel was introduced stably in the longitudinal direction in the inner spiral grooved tube formed by using the production apparatus shown in FIG. 1. In addition, the variety of the twist angles was kept in the range of plus and minus 0.5%, demonstrating that the twist angle was introduced evenly in the longitudinal direction of the tube material in an extremely high accuracy.

Example 3

Next, the inner spiral grooved tube having the inner spiral grooves of 25° in the length of 778 m was produced by using: the raw tube made of 3003 aluminum alloy with the outer diameter of ϕ=10 mm and the inner diameter of ϕ=9.0 mm, on the inner surface of which straight grooves were provided; and the apparatus shown in FIG. 1. The production was performed in the condition of: 30% of the diameter reduction ratio; 220 mm of the processing zone distance; ϕ7 mm of the outer diameter; 10 m/min of the drawing speed; and 250 rpm of the rotation speed of the unwinding side capstan.

On the inner spiral grooved tube having the length of 778 m, the twist angle (°); the outer diameter (mm); the bottom wall thickness (mm); the height of the fin (mm); the top width of the fin (mm); and the apex angle of the fin)(°) were measured at each of locations 10 m, 195 m, 389 m, 584 m, and 775 m from the start point of the processing in the longitudinal direction. Results are shown in Table 1.

Figure 12:
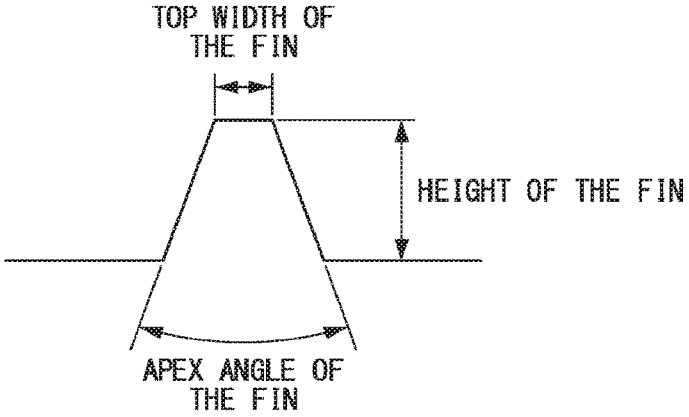
FIG. 12 is a view showing the apex angle of the fin and the top width of the fin in the inner spiral grooved tube produced in Example of the present invention.

The apex angle of the fin is the angle made by two hypotenuses on the right and the left in the fin in the isosceles shape shown in FIG. 12. The top width of the fin is the width of the fin on the top part of the fin. The height of the fin is the height from the bottom part of the fin to the top part of the fin.

Figure 13:
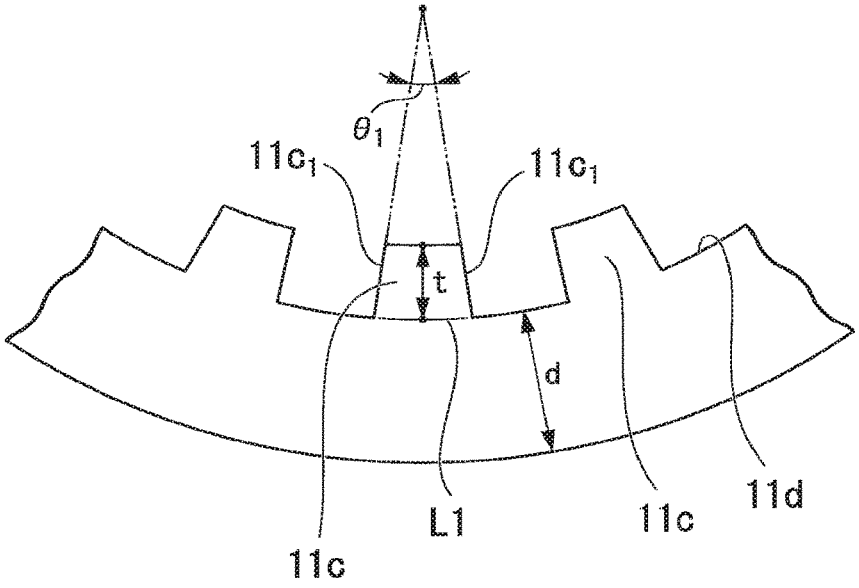
FIG. 13 is an explanatory view showing the inclination angle of the fin in the inner spiral grooved tube produced in Example of the present invention.
Figure 14:
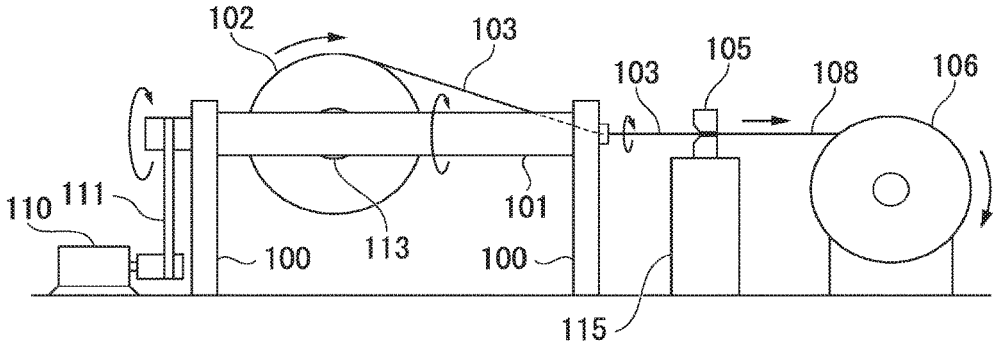
FIG. 14 is a configuration diagram showing an example of a conventional apparatus for producing an inner spiral grooved tube using a drawing die.
Figure 15:
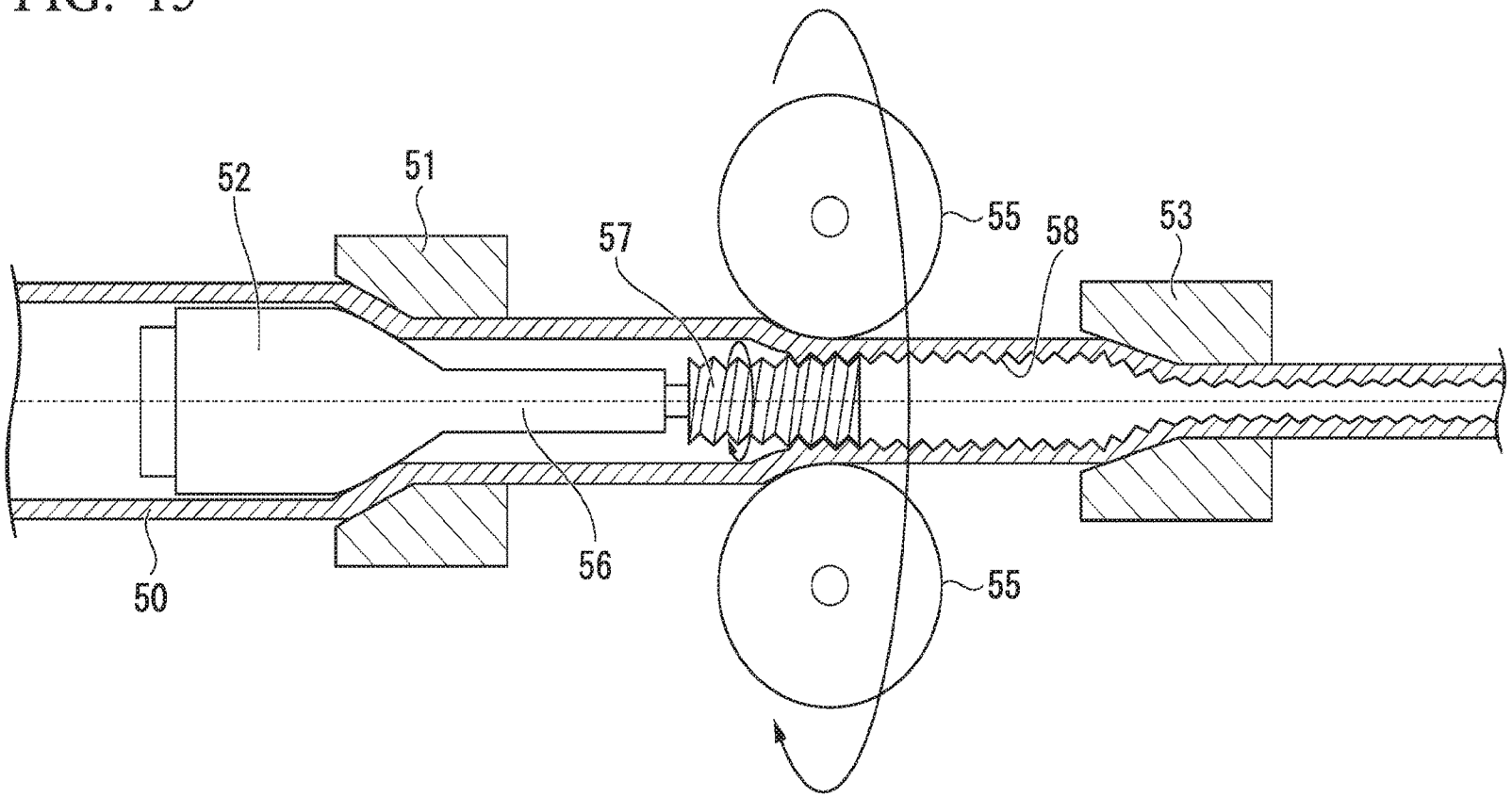
FIG. 15 is a cross-sectional view of the apparatus for carrying out the groove rolling method.
Figure 16:
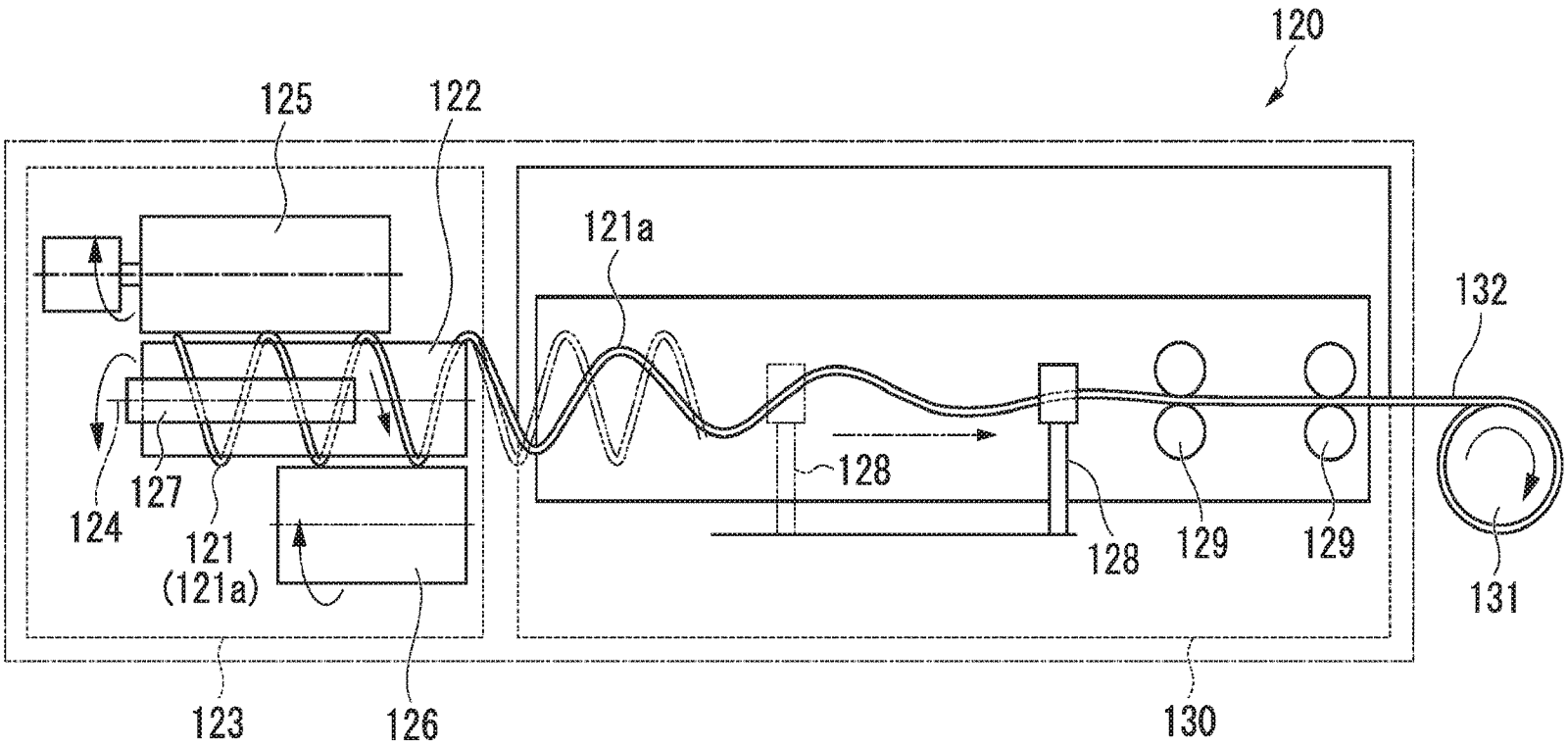
FIG. 16 is a configuration diagram showing an example of an apparatus for producing an inner spiral grooved tube by winding and extruding the extruded raw tube around the outer periphery of a drum.

The bottom wall thickness is the wall thickness of the inner spiral grooved tube 11R corresponding to the part of the spiral groove 11*d* as shown in FIG. 13. The inner spiral grooved tube 11R has a circular cross section. Thus, strictly speaking, the height of the fin was measured as the height t between the midpoint of the bottom side of the fin 11*c* and the midpoint of the top side of the fin 11*c* as shown in FIG. 13.

In addition, TS (tensile strength), YS (proof strength), and EL (elongation) were measured by cutting out a part of the obtained inner spiral groove tube at each of locations in the length of 140 mm and using the cut out tubes as the testing pieces directly.

TABLE 1

| Measurement location | Twist angle (°) | Outer diameter (mm) | Bottom wall thickness (mm) | Height of the fin (mm) | Top width of the fin (mm) | Apex angle of the fin (°) | TS (MPa) | YS (MPa) | EL %( ) |
|---|---|---|---|---|---|---|---|---|---|
| Target value | 25 | 7 | 0.5 | 0.21 | 0.11 | 15 | — | — | — |
| 10 m | 25.5 | 7.02 | 0.504 | 0.214 | 0.108 | 15.5 | 174 | 152 | 6.9 |
| 195 m | 24.8 | 7.01 | 0.496 | 0.208 | 0.107 | 15.8 | 174 | 153 | 6 |
| 389 m | 25.3 | 7.04 | 0.495 | 0.212 | 0.109 | 14.8 | 170 | 151 | 5.7 |
| 584 m | 24.9 | 6.98 | 0.505 | 0.212 | 0.113 | 14.9 | 172 | 154 | 6.2 |
| 775 m | 25 | 7.02 | 0.505 | 0.21 | 0.112 | 15.7 | 169 | 150 | 5.8 |

From the results shown in Table 1, it was demonstrated that the inner spiral grooved tube produced by the apparatus shown in FIG. 1 had: longitudinally even twist angle; the outer diameter; the height of the fin; the top width of the fin; and the apex angle of the fin, even it was the inner spiral grooved tube having the length of about 778 m. In terms of the twist angle, it was within plus and minus 0.5% relative to the targeted angle of 25°.

In addition, varieties of TS, YS, and EL in the obtained inner spiral grooved tube were small; and it was demonstrated that it was processed evenly.

The present invention is not limited by the descriptions of the embodiments. In terms of the material, it is not limited particularly to aluminum alloy, can be used for copper alloy and the like. The present invention can be modified in many ways without deviating from the scope of the present invention.

INDUSTRIAL APPLICABILITY

According to the present invention, a heat transfer tube having an even higher performance can be provided at a lower cost. Thus, the present invention contributes to: improving the performance; reducing the weight; reducing the cost; and the like of a heat exchanger.

REFERENCE SIGNS LIST

A: Apparatus for producing an inner spiral grooved tube
11: Raw tube
11*a*: Straight groove
11*b*: Fin
11R: Inner spiral grooved tube
21: Drum (unwound side drum)
21*a*: Winding shaft
22: Unwinding side capstan
23: Rotation part
24: Drawing die
24*a*: Die hole
25: Drawing side capstan
26: Second drawing die
27: Third capstan
29: Winding drum
31: Guide pulley
32: Frame (first frame)
38: Second frame
C: Central axis (central axis of the rotation part)
C1: Central axis (central axis of the processing zone)

What is claimed is:

1. A method for producing an inner spiral grooved tube comprising the steps of:

unwinding a raw tube from a drum to an unwinding side capstan while the raw tube is rotated around a central axis perpendicular to a winding shaft of the drum by rotating the drum and the unwinding side capstan about the central axis concurrently with unwinding of the raw tube from the drum holding the raw tube, on an inner surface of which a plurality of straight grooves along a longitudinal direction of the raw tube is formed with an interval in a circumferential direction, in a coil shape, to wind the raw tube around the unwinding side capstan; and twisting and drawing the unwound raw tube by introducing twist to the unwound raw tube while a diameter of the unwound raw tube is reduced by being passed through a drawing die, to obtain an inner spiral grooved tube.

2. The method for producing an inner spiral grooved tube according to claim 1, wherein a diameter reduction ratio of the drawing die is 5% to 40%.

3. The method for producing an inner spiral grooved tube according to claim 1, wherein a foremost location, on which the raw tube is wound around the unwinding side capstan; and a foremost location, on which the raw tube is sent from the unwinding side capstan to a side of the drawing die, are displaced in a direction parallel to a rotation axis of the unwinding side capstan for an interspace between the unwinding side capstan and the drawing die to be a twist processing zone of the raw tube.

4. The method for producing an inner spiral grooved tube according to claim 1, wherein forward and backward tension are introduced in the raw tube during reducing the diameter of the raw tube with twisting by passing the raw tube through the drawing die.

5. The method for producing an inner spiral grooved tube according to claim 1, wherein the inner spiral grooved tube passing through the drawing die is wound around a drawing side capstan.

6. The method for producing an inner spiral grooved tube according to claim 5, wherein the inner spiral grooved tube unwound from the drawing side capstan is shaped into a form with a second drawing die.

7. The method for producing an inner spiral grooved tube according to claim 1, wherein the raw tube unwound from the drum is shaped into a perfect circle shape with the drawing die before the raw tube reaches to the unwinding side capstan.

8. The method for producing an inner spiral grooved tube according to claim 1, wherein the raw tube is an extruded raw tube made of aluminum or aluminum alloy.

* * * * *